United States Patent [19]

McGuire

[11] 4,102,226

[45] Jul. 25, 1978

[54] JAR OPENING APPARATUS

[76] Inventor: John McGuire, 198-40 32nd Ave., Bayside, N.Y. 11360

[21] Appl. No.: 792,718

[22] Filed: May 2, 1977

[51] Int. Cl.[2] ..... B67B 7/36

[52] U.S. Cl. ..... 81/3.33; 81/3.32

[58] Field of Search ..... 81/3.31, 3.32, 3.33, 81/3.36, 3.37

[56] References Cited

U.S. PATENT DOCUMENTS

| | | | |
|---|---|---|---|
| 1,022,591 | 4/1912 | Perry | 81/3.33 X |
| 1,818,400 | 8/1931 | James et al. | 81/3.32 X |
| 1,856,827 | 5/1932 | Carruthers | 81/3.33 X |
| 2,569,239 | 9/1951 | Holmen | 81/3.32 |
| 3,837,633 | 9/1974 | Paulsen | 81/3.32 X |

*Primary Examiner*—Al Lawrence Smith
*Assistant Examiner*—James G. Smith

[57] ABSTRACT

Apparatus for opening the covers on jars including means for positioning and stationing the jar. Means for clamping the cover in the positioned jar and means for gripping the cover periphery and rotating the gripping means are provided to rotate the cover to an opened position while the jar is positioned and stationed.

4 Claims, 3 Drawing Figures

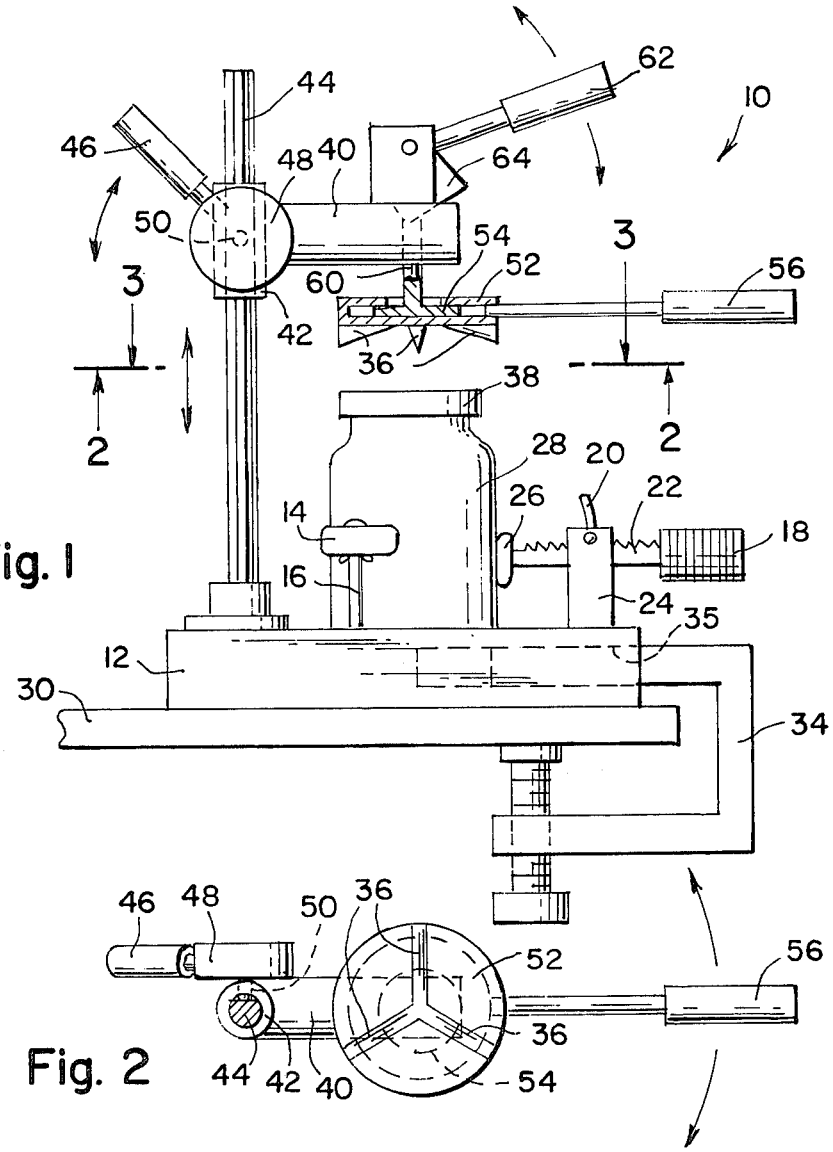
Fig. 1
Fig. 2
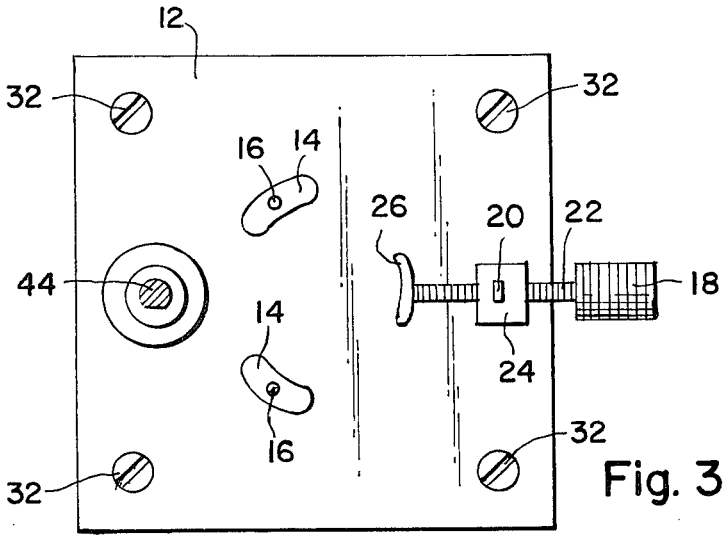
Fig. 3

JAR OPENING APPARATUS

PRIOR ART

The following United States Patents are considered pertinent:

U.S. Pat. Nos. 2,162,445; 2,554,948; 2,566,598; 2,569,239; 2,897,699; 3,158,879; 3,795,195; 3,812,742.

BACKGROUND OF THE INVENTION

This invention relates to an apparatus for removing covers from jars, particularly from jars which are packed with a product under vacuum.

Many food products are packed in jars under vacuum which are covered with a screw-on top. Oftentimes it is difficult for a person of average strength to manually remove the cover. Thus, the use of a tool is necessitated which may permanently bend the top so that it cannot be replaced tightly after a portion of the food product has been removed from the jar. This may lead to undesirable contamination of the unused product remaining in the jar.

It is an object of this invention to provide a manually operated apparatus for opening screw-on covers on jars or bottles.

Further objects of this invention will become evident in view of the following detailed disclosure.

SUMMARY OF THE INVENTION

In accordance with this invention, an apparatus for opening the cover of a jar or bottle is provided including an adjustable means for securing a jar or bottle to a base. A cover grip is mounted on an arm which in turn is slidably mounted on a shaft so that the cover grip can be vertically positioned. The cover grip is provided with beveled gripping surfaces so that force applied to the gripping surface can be concentrated on the outer peripheral surface of the cover. The gripping surface is attached to means for clamping the gripping surfaces on the cover. A handle is connected to means for supporting the gripping surface so that manual force applied to the handle is translated to the gripping surface in order to rotate the jar top and remove it from the jar.

BRIEF DESCRIPTION OF THE DRAWINGS

FIG. 1 is a side view, in partial cross-section of the jar opening apparatus of this invention.

FIG. 2 is a cross-sectional view of the apparatus of FIG. 1 taken along line 2—2.

FIG. 3 is a cross-sectional view of the apparatus of FIG. 1 taken along line 3—3.

DETAILED DESCRIPTION OF THE PREFERRED EMBODIMENT

Referring to the figures, the jar opening apparatus 10 comprises a base 12 to which are attached jar gripping surfaces 14 pivotally mounted on shafts 16 and a jar clamp 18 comprising a lever 20, a ratchet 22, a ratchet support 24 and a jar gripping surface 26 to secure jar 28 on base 12. The base 12 can be secured to table top 30 either with screws 32 or by C-clamp 34 which fits in hole 35 of base 12.

The gripping surfaces 36 are beveled and are vertically adjustable with respect to the jar cover 38 by being attached to arm 40 which, in turn is attached to sleeve 42 which is slidably mounted on shaft 44. Sleeve 42 is loosened from or secured to shaft 44 by handle 46, lock wheel 48 and set screw 50. Gripping surfaces 36 are secured to sleeve 52 slidably mounted on plate 54. A handle 56 is attached to sleeve 52 to manually rotate sleeve 52 and gripping surfaces 36 when gripping surfaces 36 are contacted under pressure with the jar top 38. Sleeve 54 is movable with respect to plate 54 in order to adjust the position of the center line of the gripping surfaces 36 so that the apparatus can accommodate different sized jars 28 and covers 38.

Plate 54 is attached to shaft 60 which is slidably mounted in arm 40. Pressure on the gripping surfaces which is transmitted to the cover 38 when they are in contact is effected by handle 62 attached to cam 64 which bears on the top surface of shaft 60. When the gripping surfaces 36 contact the cover 38 under pressure, manual pressure is applied to handle 56 to rotate surfaces 36 and cover 38 so that the jar 28 is opened.

It is to be understood that this invention is not limited to the embodiments specifically described but includes modifications which will be obvious to the person skilled in the art.

I claim:

1. An apparatus for opening a cover of a container comprising:

(a) a base;

(b) means on said base for securing a container in a stationary position;

(c) arm means adjustably secured to said base;

(d) positioning means on said base for releasably securing said arm means in a variety of vertical positions above said base;

(e) gripping means movably secured to said arm to contact said cover;

(f) said gripping means comprising a plate and means on said arm means for adjusting the position of said plate relative to said arm means; a disc shaped sleeve member slidably and rotatably secured to said plate by means of an enlarged slot encompassing a said plate and;

(g) gripping surfaces on said sleeve member for gripping said cover.

2. The apparatus of claim 1 wherein said gripping surfaces comprises a plurality of beveled surfaces.

3. The apparatus of claim 1 wherein said positioning means includes a sleeve slidable on a first axis and connected to said arm means and said means for adjusting the position of said plate includes a second shaft secured to said plate at one end and a cam means secured to the other end of said shaft for applying pressure to said gripping surfaces.

4. The apparatus of claim 1 comprising means on said base for attaching said base to a surface.

* * * * *